United States Patent [19]

Peetz et al.

[11] 4,210,215

[45] Jul. 1, 1980

[54] ROCK DRILL WITH HELICAL DUST CONVEYING GROOVE

[75] Inventors: Wolfgang Peetz, Blitzenreute; Siefgried Klaissle, Unterankenreute, both of Fed. Rep. of Germany

[73] Assignee: Hawera Probst GmbH & Co., Ravensburg, Fed. Rep. of Germany

[21] Appl. No.: 929,268

[22] Filed: Jul. 31, 1978

[30] Foreign Application Priority Data

Aug. 4, 1977 [DE] Fed. Rep. of Germany ..... 2735227

[51] Int. Cl.[2] ..... E21B 9/04

[52] U.S. Cl. ..... 175/394; 175/310; 175/323; 408/230; 198/676

[58] Field of Search ..... 175/310, 323, 388, 394; 145/116 R; 299/87; 408/230; 198/676

[56] References Cited

U.S. PATENT DOCUMENTS

| | | | |
|---|---|---|---|
| 335,469 | 2/1886 | Moreau | 408/230 X |
| 2,045,725 | 6/1936 | Richardson | 175/394 |
| 2,084,737 | 6/1937 | Magnus | 408/230 |
| 2,859,645 | 11/1958 | Emmons et al. | 408/230 |
| 3,469,643 | 9/1969 | Terhorst | 175/394 |
| 3,749,189 | 7/1973 | Boehm | 175/394 |

FOREIGN PATENT DOCUMENTS

| | | | |
|---|---|---|---|
| 2159728 | 6/1973 | Fed. Rep. of Germany | 175/394 |
| 6603310 | 9/1966 | Netherlands | 175/394 |

*Primary Examiner*—Ernest R. Purser
*Assistant Examiner*—Nick A. Nichols, Jr.
*Attorney, Agent, or Firm*—Becker & Becker, Inc.

[57] ABSTRACT

A rock drill, especially for rotary blow machines and drifters or stoppers with drilling cutting edges and at least one drilling dust conveying groove which in axial direction is confined by a web which extends around the drill axis and one lateral surface of which forms a drilling dust supporting surface which merges with the bottom of the drilling dust conveying groove. The bottom of the drilling dust conveying groove extends from the drilling dust supporting surface at an acute angle with regard to the drill axis rectilinearly up to the back surface of the web. The ratio of the width of the drilling dust conveying groove, measured in axial direction of said drill, to the width of the back of the web is greater than 5:1.

12 Claims, 4 Drawing Figures

ROCK DRILL WITH HELICAL DUST CONVEYING GROOVE

The present invention relates to a rock drill, especially for rotary blow machines and drifters or stopers with drilling cutting edges and with at least one groove for the drilling dust. This groove is confined in axial direction by a helical web extending around the axis of the drill while one side surface of the web forms a supporting surface for the drilling dust, the supporting surface merging with the bottom of the groove for the drilling dust.

With a heretofore known rock drill of this type, the groove bottom extends nearly over the entire width of the groove parallel to the axis of the drill so that a groove for the drilling dust is formed which in axial section has an approximately rectangular cross section. The bottom of this groove merges with the web of the approximately rectangular cross section, which web confines the groove for the drilling dust in axial direction of the drill.

In view of the rectangular design, the web wears relatively quickly during use of the drill. With increasing wear of the web, the depth of the groove for the drilling dust decreases so that prematurely a poor movement of the drilling dust in the groove will take place. The drilling dust will in such an instance no longer be removed to a sufficient extent from the hole to be drilled and an accumulation of drilling dust occurs in the groove whereby the drilling progress is slowed down. Under certain circumstances the drilling machine may even come to a standstill. The decreasing drilling process also subjects the drill to an undue load so that the drill might even break.

It is an object of the present invention to provide a rock drill which also after a longer time of operation will assure a fast drilling progress, even when used in very powerful drilling machines.

This object and other objects and advantages of the invention will appear more clearly from the following specification in connection with the accompanying drawing, in which.

Figure 4:
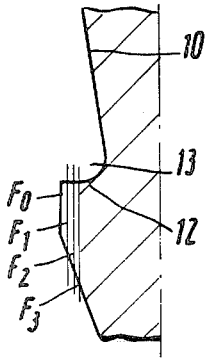
FIG. 4 shows on an enlarged scale a cutout of FIG. 3.

The rock drill according to the present invention is characterized primarily in that the bottom of the groove for the drilling dust extends rectilinearly from the supporting surface of the drilling dust at an acute angle with regard to the drilling axis of the drill to the back surface of the web, and is furthermore characterized in that the ratio of the width of this groove, when measured in axial direction of the drill, to the width of the back of the web is greater than 5:1.

As a result thereof, an asymmetrical design of the groove is obtained which has its maximum depth in the region of the supporting surface for the drilling dust, while this depth is steadily decreasing in the direction toward the web. Inasmuch as the transport of the drilling dust in the groove normally occurs in the lower third of the groove, the drilling dust has a sufficiently large space available so that it can quickly be transported out of the hole being drilled. The width of the web is, in view of the design according to the present invention, rather small in comparison to the width of the groove, whereby only a slight friction is encountered at the wall of the hole being drilled and consequently a fast drilling process is assured. The cross-sectional surface of the web steadily increases in the direction toward the axis of the drill in view of the inclined and rectilinearly extending groove bottom. Thus, with increasing wear of the web, the cross section of the back surface increases, whereby a considerable reduction in wear will be realized. The removal of material from the web per time unit continuously decreases so that only a slight decrease in the drilling dust supporting surface occurs which does not affect the fast removal of the drilling dust. The supporting surface for the drilling dust remains sufficiently large to assure a fast transport of the drilling dust and thus a fast drilling progress. The rock drill according to the invention is, in view of its low wall friction, the good transport of the drilling dust, and the fast drilling progress very favorable for use in connection with small and low-power drilling machines.

Referring now to the drawing in detail, the rock drill shown therein is particularly well suited for rotary blow drilling and comprises a drilling cutting blade 1 which is preferably formed by a soldered-in hard metal plate. The blade 1 comprises two blade sections 1*a* and 1*b* arranged in a roof-like manner with regard to each other. Each of the blade sections 1*a* and 1*b* has associated therewith a drilling dust groove 2 and 3 respectively. The grooves 2 and 3 extend helically about the axis 4 of the drill and in axial direction are confined by webs 5 and 6 extending helically around the axis of the drill. In the region of the tip of the drill, the web end is rectilinear, whereby a good support of the hard metal plate at both sides and large soldering surfaces for a safe connection of the hard metal plate to the drill body are obtained. In the region of the chucking end of the drill, the grooves 2 and 3 merge with a cylindrical section 7 of the drill which is adjacent the chucking end 8.

Figure 1:
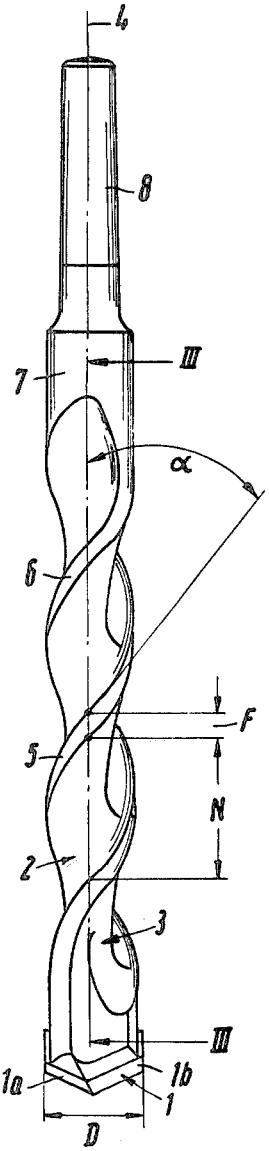
FIG. 1 is a side view of a rock drill according to the invention.
Figure 2:
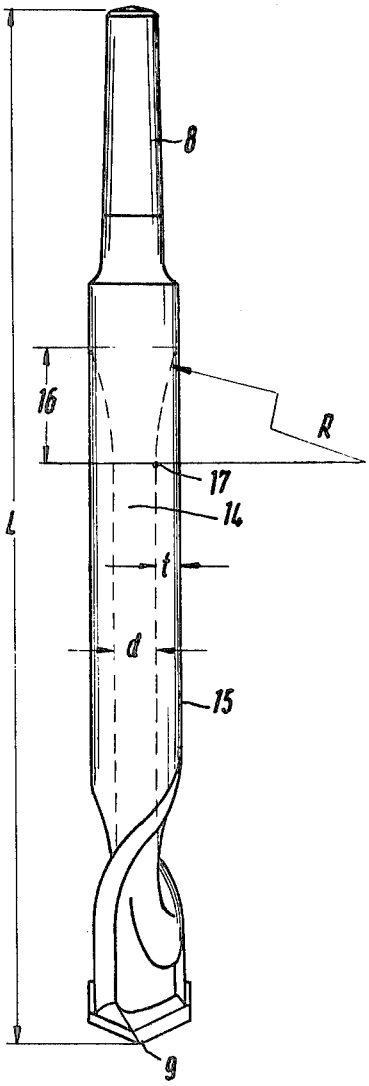
FIG. 2 shows the rock drill of FIG. 1 in which only a portion of the drilling grooves is shown.

The rock drill according to the invention preferably has a diameter of from 5 to 20 mm and is intended for deep drilling. Advantageously, the ratio of the drill length L to the rated diameter D amounts to about 20:1. As shown in FIG. 1, the rated diameter D is determined by the width of the hard metal plate 1. The length L of the drill corresponds to the distance between the drill tip 9 and the free end of the chucking end 8 (FIG. 2). The angle of inclination $\alpha$ of the two grooves 2 and 3 advantageously amounts to not more than 40°. In view of this relatively small inclination of the grooves 2 and 3, the transport of the drilling dust is improved.

Figure 3:
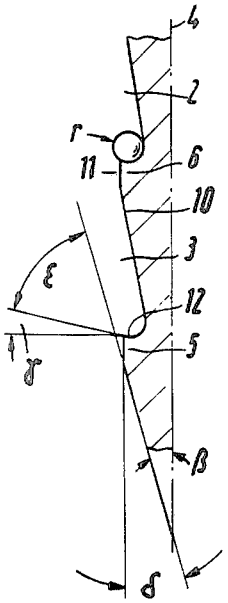
FIG. 3 represents a section taken along the line III—III of FIG. 1.

As shown in FIGS. 3 and 4, the grooves 2, 3 have an asymmetrical cross section. The bottom 10 of the grooves 2, 3, when seen in axial section, is rectilinear over its entire length, and with the axis 4 of the drill forms an angle $\beta$ of approximately 15°. That end of the groove bottom 10 which faces the chucking end 8 joins the back surface 11 of the web 5, 6 at an angle. Advantageously the angle $\delta$ between the groove bottom 10 and the back surface 11 amounts to about 15° (FIG. 3). That end of the groove bottom 10 which faces toward the drill tip 9 merges along an arc with the supporting surface 12 for the drilling dust. The supporting surface 12 is undercut by an angle $\gamma$ of about 5° to 10°. As a result thereof, the supporting surface for the drilling dust will in the region of the back surface of web 5, 6 define with the axis 4 of the drill an acute angle which opens in the direction toward the chucking end 8. The drilling dust on the supporting surface will, in view of the undercut, during the drilling operation, in view of axial shocks be moved in the direction toward the groove bottom 10, in other words, into the collecting chamber 13 of the grooves 2, 3. The drilling dust will therefore during the drilling operation remain in the grooves 2, 3 and will be quickly transported out of the hole being drilled.

In order to obtain as large a collecting chamber 13 as possible in the region of the supporting surface 12, this supporting surface 12 is nearly over its entire length located on a circular arc having a radius r which amounts to about from 0.7 to 0.8 times the distance t between the drill core 14 and the enveloping surface 15 for the drill (FIG. 2). As a result thereof, the drill has, in addition to a large collecting chamber 13, also a sufficient thickness so that the drill will in this area have a sufficient resistance against buckling. The wedge angle $\epsilon$ between the supporting surface 12 for the drilling dust and the bottom 10 of the groove following in the direction toward the drill tip amounts to from 70° to 80°.

In the axial section, the depth of the groove steadily decreases from the drilling dust supporting surface 12 in the direction toward the chucking end 8. In view of the relatively small angle $\delta$ between the back surface of the web 5, 6 and the groove bottom 10, the cross-sectional surface of the webs 5, 6 increases in the direction toward the axis 4 of the drill. As will be clearly seen from FIG. 4, in axial section, the width $F_o$ of the back quickly increases via $F_1$ and $F_2$ to $F_3$ over a small radial length. In view of the widening of the back surface in the radial direction, the wear per time unit is greatly reduced with increasing time of use. As a result thereof, a fast drilling progress remains and a quick and proper removal of the drilling dust is assured, even after a long period of use of the drill. The wear of the back of web 5, 6 is also, due to the asymmetrical design of the grooves 2, 3, not linear so that also after a long period of use only a slight radial decrease in the thickness of the web 5, 6 is encountered and a correspondingly slight radial decrease in the supporting surface 12 for the drilling dust. The transport of the drilling dust is thus for all practical purposes not affected so that a fast drilling progress will be obtained.

For reducing the wall friction, the ratio of the groove width N for the drilling dust to the width F of the back is advantageously selected greater than 5:1. At such a ratio, the webs 5, 6 have only a slight width whereby the friction on the wall of the hole being drilled is reduced and the size of the grooves 2, 3 for the drilling dust is increased. The reduced width of the web and the thus obtained increase in the grooves 2, 3 increase the useful life of the drill and improve the drilling progress. Expediently, the width F of the back amounts to about from 1/5 to 1/10 of the rated diameter D of the drill. As a result thereof, the width of the back of the webs is small also with large rated diameter, and the grooves 2, 3 for the drilling dust are correspondingly large so that the drilling dust obtained with large drills can be properly removed from the hole being drilled to a greater extent.

For improving the transport of the drilling dust, the drill core 14 is nearly over the entire length of the grooves 2, 3 cylindrical (FIG. 2) in which connection the cylinder axis is formed by the axis 4 of the drill. The drill core 14 is formed by that section of the drill which is surrounded by the grooves 2, 3. The diameter d of the drill core 14 is not larger than half the rated diameter D so that the drill will have a high resistance against buckling. Merely in the end region of the drill, the drill core 14 widens in the direction of the drill shank 8. Advantageously, this widening of the drill core 14, when seen in axial section, is not linear but parabolic or hyperbolic. As a result thereof, the course of the grain of the drill is only slightly disturbed in this region. Advantageously, the increase of the core cross section is effected over an axial length 16 of not more than 30% of the entire axial length of the web 5, 6. Expediently, the drill core 14, when seen in axial direction, widens circularly with a radius R amounting to at least 100 mm. Due to this high increase in the thickness of the core over a short length of the drill in the region of the outer end of the grooves 2, 3 directly below the cylindrical drill section 7, the drill is able safely to absorb high alternating bending stresses occurring during operation which may be encountered, for instance, by a nonprecise guiding of the drilling machine at nearly completed drilling depth. The high alternating bending stresses must then be absorbed over a relatively short free bending length. This is accomplished by the great increase in the thickness of the core. As a result thereof, in view of the slender design of the drill, breaks in the shank are avoided. As shown in FIG. 2, when seen in axial section, the tangential plane which in the transition area 17 is placed, from the widened drill core section to the cylindrical core section 14, onto the circle containing the outside of the widened drill core section, is formed by the outside of the cylindrical drill core section 14. The cylindrical drill core thus steadily merges with the widened region so that the course of the grain is only slightly disturbed and the strength is sufficiently high in this region.

The rock drill, due to its slender design, has a relatively large space for the transport of the drilling dust whereby the drilling speed is favored. The asymmetrical design of the grooves 2, 3 results in a reduction of the wall friction while simultaneously a sufficiently large space is available for the transport of the drilling dust. Inasmuch as the drill core 14 has a constant diameter d nearly over the entire length of the grooves for the drilling dust, the depth of the grooves 2, 3 is not changed over the length of the drill so that over the entire length of the drill a proper transport of the drilling dust can occur.

What we claim is:

1. A rock drill, especially for rotary blow machines and drifters and stopers, with drilling cutting edges, which includes at least one drilling dust conveying groove, web means extending around the axis of said drill and confining at least one drilling dust conveying groove in axial direction, said web means comprising a back surface and a lateral surface forming a drilling dust supporting surface merging with the bottom of said at least one drilling dust conveying groove, said bottom of said at least one drilling dust conveying groove extending from said drilling dust supporting surface at an acute angle with regard to the axis of said drill rectilinearly up to said back surface of said web means, the ratio of the width of said at least one drilling dust conveying groove measured in the axial direction of said drill to the width of the back surface of said web means being in excess of 5:1, the wedge angle between said groove bottom and said drilling dust supporting surface amounting to from 70° to 80°.

2. A rock drill according to claim 1, in which the width of said back surface of said web means is within the range of from about 1/5 to 1/10 of the rated diameter of said drill.

3. A rock drill, according to claim 1, in which said groove bottom merges along an arc with said drilling dust supporting surface which is undercut by an acute angle.

4. A rock drill according to claim 3, in which said undercut acute angle is within the range of from 5° to 10°.

5. A rock drill according to claim 1, in which said drill has a drill core extending in the axial direction of said drill and also has an enveloping surface, and in which said drilling dust supporting surface viewed in axial section is located on a portion of an arc the radius of which amounts to about from 0.7 to 0.8 times the distance between said drill core and said enveloping surface of said drill.

6. A rock drill according to claim 5, in which said drill core is substantially cylindrical over nearly the entire drill length which comprises said at least one drilling dust conveying groove, the axis of said substantially cylindrical drill core coinciding with the axis of said drill.

7. A rock drill according to claim 5, in which the diameter of said drill core within the cylindrical region of said drill does not exceed half the rated diameter of said drill.

8. A rock drill according to claim 5, in which said drill has a chucking end, and in which said drill core widens in the direction toward said chucking end within the region of said chucking end.

9. A rock drill according to claim 8, in which said drill core when viewed in axial section widens parabolically or hyperbolically in the direction toward and within the region of said chucking end.

10. A rock drill according to claim 8, in which said drill core when viewed in axial section widens in an arc-shaped manner in the direction toward and within the region of said chucking end.

11. A rock drill according to claim 8, in which the widening of the core section extends over an axial length not exceeding 30% of the total helical length of said at least one drilling dust conveying groove.

12. A rock drill according to claim 8, in which, when viewed in axial section, the tangent to that circle which contains the outside of said widened drill core section in the transition area from the cylindrical drill core section to the widened drill core section is formed by the outside of said cylindrical drill core section.

* * * * *